United States Patent [19]

Hall et al.

[11] 4,384,856

[45] May 24, 1983

[54] LATERAL SUPPORT ARRANGEMENT FOR OUTBOARD MOTOR WITH SEPARATE TILT AND TRIM AXES

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 173,162

[22] Filed: Jul. 28, 1980

[51] Int. Cl.[3] ..... B63H 21/26

[52] U.S. Cl. ..... 440/61; 248/642; 440/63

[58] Field of Search ..... 440/53, 55, 56, 61, 440/62, 63; 248/640–643

[56] References Cited

U.S. PATENT DOCUMENTS

| | | | |
|---|---|---|---|
| 871,459 | 11/1907 | Thorsen | 248/643 |
| 1,172,176 | 2/1916 | Stanley | 440/55 |
| 1,734,910 | 11/1929 | King et al. | 440/53 |
| 2,138,600 | 11/1938 | Harmon | 248/641 |
| 4,177,747 | 12/1979 | Pichl | 248/642 |

FOREIGN PATENT DOCUMENTS

| | | | |
|---|---|---|---|
| 949624 | 9/1956 | Fed. Rep. of Germany | 440/53 |

*Primary Examiner*—Sherman D. Basinger
*Attorney, Agent, or Firm*—Michael, Best & Friedrich

[57] ABSTRACT

Disclosed herein is an outboard motor comprising a transom bracket adapted to be connected to a boat transom, a propulsion unit which is mounted to the transom bracket for pivotal steering movement of the propulsion unit in a horizontal plane and for pivotal movement of the propulsion unit in a vertical plane between a lowermost running position and a full tilt position, which propulsion unit mounting includes a first pivot connecting an intermediate bracket to the transom bracket for pivotal movement of the intermediate bracket relative to the transom bracket about a first pivot axis which is horizontal when the transom bracket is boat mounted, whereby to enable movement of the propulsion unit through a tilt range, a second pivot connecting a swivel bracket to the intermediate bracket for pivotal movement of the swivel bracket with the intermediate bracket and relative to the intermediate bracket about a second pivot axis parallel to the first pivot axis, whereby to enable movement of the propulsion unit through a trim range, and a king pin pivotally connecting the propulsion unit to the swivel bracket for steering movement of the propulsion unit relative to the swivel bracket about a generally vertical axis and for common pivotal movement with the swivel bracket in a vertical plane about the first and second horizontal axes, hydraulic cylinders for sequentially displacing the propulsion unit from the lowermost position through the trim range and then through the tilt range to the full tilt position, and a support on the transom bracket for providing side support to the intermediate bracket.

14 Claims, 7 Drawing Figures

11
13
15
17
19
21
23
25
27
29
31
33
35
39
41
43
47
49
61
63
65
71
75
77
91
93
95
101
107
111

11
13
15
17
19
21
23
25
27
29
31
33
35
39
41
43
45
47
49
57
59
61
63
71
75
77
91
93
95
101
107
111
4
1

LATERAL SUPPORT ARRANGEMENT FOR OUTBOARD MOTOR WITH SEPARATE TILT AND TRIM AXES

RELATED APPLICATIONS

Reference is hereby made to the following related applications, all of which are assigned to the assignee of this application and all of which are incorporated herein by reference:

Stevens application Ser. No. 159,480, filed June 16, 1980, now U.S. Pat. No. 4,355,986, and entitled OUTBOARD MOTOR WITH ELEVATED HORIZONTAL PIVOT AXIS.

Blanchard application Ser. No. 167,337, filed July 9, 1980, and entitled OUTBOARD MOTOR WITH DUAL TRIM AND TILT AXES.

Hall et al. application Ser. No. 173,159, filed July 28, 1980, now U.S. Pat. No. 4,354,848, and entitled OUTBOARD MOTOR WITH TILT LINKAGE INCLUDING PIVOT LINK.

Hall et al. application Ser. No. 173,158, filed July 28, 1980, and entitled MARINE PROPULSION DEVICE STEERING MECHANISM.

Hall et al. application Ser. No. 183,209, filed Sept. 2, 1980, now U.S. Pat. No. 4,363,629, and entitled HYDRAULIC SYSTEM FOR OUTBOARD MOTOR WITH SEQUENTIALLY OPERATING TILT AND TRIM MEANS.

Hall et al. application Ser. No. 173,160, filed July 28, 1980, and entitled OUTBOARD MOTOR WITH SEQUENTIALLY OPERATING TILT AND TRIM MEANS.

BACKGROUND OF THE INVENTION

The invention relates generally to marine propulsion devices and, more particularly, to outboard motors including propulsion units which are steerable in a horizontal plane and tiltable in a vertical plane.

The invention also relates to outboard motors having separate upper and lower or tilt and trim axes as disclosed in the above identified Blanchard application Ser. No. 167,337, filed July 9, 1980. In such outboard motors, when the propulsion unit is tiltably pivotally connected to the transom about a relatively elevated horizontal pivot, the arrangement for transmission of side loading to the boat transom from the propulsion unit is important.

Attention is also directed to the Pichl U.S. Pat. No. 4,177,747 issued Dec. 11, 1979.

SUMMARY OF THE INVENTION

The invention provides an outboard motor comprising transom bracket means adapted to be connected to a boat transom, a propulsion unit including a propeller, means mounting the propulsion unit to the transom bracket means for pivotal steering movement of the propulsion unit in a horizontal plane about a vertical axis and for pivotal movement of the propulsion unit in a vertical plane between a lowermost running position and a full tilt position, and through a trim range extending upwardly from the lowermost running position to a full trim position, and through a tilt range extending upwardly from the full trim position, and through a tilt range extending upwardly from the full trim position to the full tilt position, which propulsion unit mounting means comprises an intermediate bracket, first pivot means connecting the intermediate bracket to the transom bracket means for pivotal movement of the intermediate bracket relative to the transom bracket means about a first pivot axis which is horizontal when the transom bracket means is boat mounted, whereby to enable movement of the propulsion unit through the tilt range, a swivel bracket, second pivot means connecting the swivel bracket to the intermediate bracket for pivotal movement of the swivel bracket with the intermediate bracket about a second pivot axis parallel to the first pivot axis, whereby to enable movement of the propulsion unit through the trim range, and means pivotally connecting the propulsion unit to the swivel bracket for steering movement of the propulsion unit relative to the swivel bracket about a generally vertical axis and for common pivotal movement with the swivel bracket in a vertical plane about the first and second horizontal axes, means for sequentially displacing the propulsion unit from the lowermost position through the trim range and then through the tilt range to the full tilt position, and means on the transom bracket means and on the intermediate bracket for providing side support to the intermediate bracket.

In one embodiment of the invention, the means for providing side support extends rearwardly sufficiently to provide side support to the intermediate bracket when the propulsion unit is within a limited portion of the tilt range extending upwardly from the full trim position.

In one embodiment of the invention, the swivel bracket has a vertical leg, the intermediate bracket has, at its lower end, a rearward part extending to adjacent the vertical leg of the swivel bracket, and the support bracket extends to adjacent the rearward part of the intermediate bracket.

In one embodiment in accordance with the invention, the means for providing side support for the intermediate bracket comprises a support bracket forming a part of the transom bracket and including a pair of laterally spaced support arms having respective side surfaces and the intermediate bracket includes side surfaces located for lateral engagement with the side surface of the support bracket for transmission of side loading from the intermediate bracket to the support bracket.

In one embodiment in accordance with the invention, the swivel bracket and the intermediate bracket include means providing side support to the swivel bracket in all positions of the swivel bracket relative to the intermediate bracket.

In one embodiment in accordance with the invention, the means providing side support to the swivel bracket in all positions of the swivel bracket comprises laterally spaced side surfaces on said intermediate bracket, and the swivel bracket includes a forwardly extending part having side surfaces located for lateral engagement of the side surfaces of the intermediate bracket for transmission of side loading from the swivel bracket to the intermediate bracket.

In one embodiment in accordance with the invention, the first pivot is located rearwardly of the boat transom and the first and second pivot axes are spaced apart with the second pivot axis located below the first pivot axis.

Other features and advantages of the embodiments of the invention will become known by reference to the following general description, claims and appended drawings.

IN THE DRAWINGS

Figure 2:
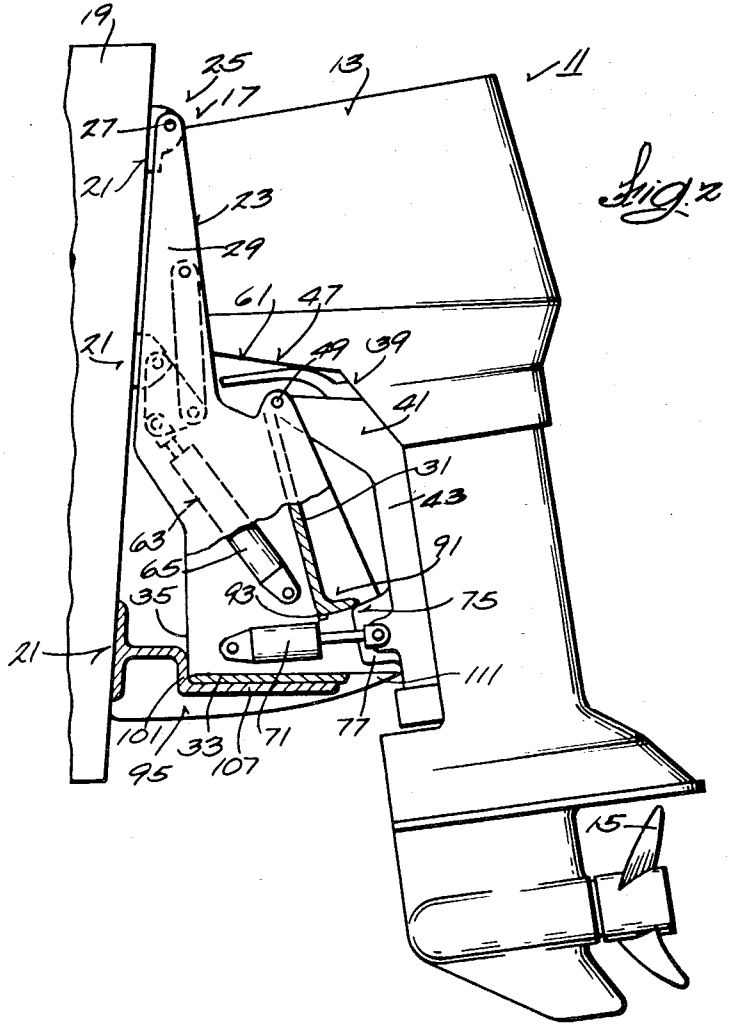
FIG. 2 is a view similar to FIG. 1 illustrating the outboard motor in the full trim position.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device in the form of an outboard motor 11 including a propulsion unit 13 including a propeller 15, and means 17 for pivotally mounting the propulsion unit 13 to a boat transom 19 for pivotal steering movement of the propulsion unit 13 in a horizontal plane and for vertical tilting movement of the propulsion unit 13 in a vertical plane between a lowermost running position with the propeller 15 fully submerged in water and a raised or full tilt position providing above-the-water-accessibility to the propeller 15 and through a trim range extending upwardly from the lowermost running position to a full trim position and through a tilt range extending upwardly from the full trim position to the full tilt position.

The means 17 for pivotally mounting the propulsion unit 13 can take various forms and, in the disclosed construction, such means comprises transom bracket means 21 adapted to be fixedly mounted to the rear of the boat transom 19. The transom bracket means 21 can be a unitary member or can comprise independent members each adapted for fixed connection to the boat transom 19.

The means 17 for pivotally mounting the propulsion unit 13 also includes a second or intermediate bracket 23, together with means 25 located rearwardly of the boat transom 19 for pivotally connecting the intermediate bracket 23 to the transom bracket means 21 for pivotal movement of the intermediate bracket 23 about a first or upper tilt axis 27 which is horizontal when the transom bracket means 21 is boat mounted. Any suitable means can be provided.

The intermediate bracket 23 extends downwardly from the pivot axis and can be of U-shape in horizontal cross-section including a laterally spaced pair of wing portions 29 connected, at their lower ends, by a laterally and vertically extending strengthening portion or web 31. If desired, a horizontally extending strengthening shelf or web portion 33 can extend between the wing portions 29 adjacent to the lower end thereof and preferably somewhat above the extreme lower end thereof. In addition, the wing portions 29 include, at their lower ends, forward edges 35.

As illustrated, the wing portions 29, at their lower ends, extend rearwardly to a considerably greater extent than at their upper ends with the rearward extent progressively diminishing from lower ends toward the upper ends.

The means 17 for pivotally mounting the propulsion unit 13 also includes means 39 for pivotally connecting the propulsion unit 13 to the intermediate bracket 23 for tilting movement in common with the intermediate bracket 23 and for steering movement in a horizontal plane relative to the intermediate bracket 23. While various arrangements can be employed, in the disclosed construction, the means 39 for pivotally mounting the propulsion unit 13 to the intermediate bracket 23 comprises a swivel bracket 41 including a vertical leg 43 having therein a bore 45, together with means 47 for pivotally connecting the swivel bracket 41 to the intermediate bracket 23 for pivotal movement in a vertical plane of the swivel bracket 41 with the intermediate bracket 23 and relative to the intermediate bracket 23 about a lower trim axis 49 parallel to the upper tilt axis 27. Any suitable means can be employed.

The means 39 for pivotally connecting the propulsion unit to the intermediate bracket means 23 further includes means 57 for pivotally connecting the propulsion unit 13 to the swivel bracket 41 for steering movement in a horizontal plane. While various arrangements can be employed, in the disclosed construction, a king pin 59 is fixed to the propulsion unit 13 and extends in the bore 45 in the vertical leg 43 in the swivel bracket 41, as in conventional construction.

Any suitable means can be employed for effecting steering movement of the propulsion unit 13 relative to the swivel bracket 41.

Means 61 are provided for sequentially displacing the propulsion unit from the lowermost running position through the trim range and then through the tilt range and to the full tilt position. Any suitable means can be employed. In the illustrated construction, such means 61 comprises means 63 for adjustably displacing or tilting the intermediate bracket 23 relative to the transom bracket means 21. While various arrangements can be employed, in the disclosed construction, such means comprising a suitable extensible member such as, for instance, a hydraulic tilt cylinder-piston assembly 65 which, at one end is pivotally connected, by any suitable means, to the transom bracket means 21 and which, at its other end, is suitably connected, by any suitable means, to the intermediate bracket 23.

The means 61 for sequentially displacing the propulsion unit 13 further includes means for adjustably displacing or trimming the swivel bracket 41 relative to the intermediate bracket 23 comprising a suitable extensible member such as, for instance, a hydraulic trim cylinder-piston assembly 71, which at one end, is pivotally connected, by any suitable means, to the intermediate bracket 23 and which, at the other end, is pivotally connected, by any suitable means, to the swivel bracket 41.

It is especially noted that the geometry of the mounting arrangement shown in the drawings of the trim and tilt cylinder-piston assemblies 65 and 71, because of moment arm considerations, will cause, assuming the application of equal pressure to both the tilt and trim cylinder-piston assemblies 65 and 71, and that the cross sections of the tilt and trim cylinder-piston assemblies are equal, during forward operation of the propulsion unit and in response to pressurization of the trim and tilt cylinder-piston assemblies 65 and 71, sequential full extension of the trim cylinder-piston assembly 65, followed by extension of the tilt cylinder-piston assembly 71. Any suitable arrangement can be employed for hydraulically pressurizing the tilt and trim cylinder piston assemblies 65 and 71 for extension and contraction so as to desirably locate the propulsion unit 13. One example of a particularly advantageous hydraulic system is disclosed in our co-pending application Ser. No. 183,209 filed Ser. 1, 1980.

Mounting arrangements for the tilt and trim cylinder-piston assemblies other than that shown can be employed and the desired sequential pivotal movement can be obtained by applying greater force along the axis of the trim-cylinder piston assembly as compared to along the axis of the tilt cylinder-piston assembly. Such greater force can be obtained by applying higher fluid pressures to the trim cylinder-piston assembly as compared to the tilt cylinder piston assembly and/or by increasing the cross section of the cylinder of the trim cylinder-piston assembly as compared to the cylinder of the tilt cylinder-piston assembly.

In order to receive or absorb side loading from the propulsion unit 13, means 75 are provided on the swivel bracket 41 and on the intermediate bracket 23 for providing side support to the swivel bracket 41 at all positions of the swivel bracket 41 relative to the intermediate bracket 23 within the trim range, i.e., within the range of movement of the swivel bracket 41 relative to the intermediate bracket 23.

While various arrangements can be employed, the swivel bracket 41 includes a forwardly extending part 77 which projects from the vertical leg 43, and which is received between the spaced wing portions 29 and adjacent to the horizontally extending reinforcing shelf or web 33 of the intermediate bracket 23. The forwardly extending part 77 includes side surfaces 79 (See FIGS. 4 through 7) which are located for lateral engagement with respective side surfaces 81 of the wing portions 29 of the intermediate bracket 23 for transmission therebetween from the swivel bracket 41 to the intermediate bracket 23 of side loading in all positions of the swivel bracket 41 relative to the intermediate bracket 23, i.e., within the trim range, while at the same time, permitting pivotal displacement of the swivel bracket 41 relative to the intermediate bracket 23.

Means 91 are also provided on the swivel bracket 41 and on the intermediate bracket 23 for limiting downward pivotal movement of the swivel bracket 41 relative to the intermediate bracket 23 so as to establish the lowermost running position and to provide for transmission of forward propulsive thrust when the propulsion unit 13 is in the lowermost running position.

While other arrangements can be employed, in the disclosed construction, such means 91 comprises a transversely extending vertical surface 93 on the intermediate bracket 23 located for engagement by the forwardly extending part 77 of the swivel bracket 41 to limit downward travel of the swivel bracket 41 relative to the intermediate bracket 23. When the propulsion unit 13 is in other positions within the trim range, thrust is transmitted to the intermediate bracket 23 through the trim cylinder-piston assembly 71.

Also in order to receive or absorb side loading from the propulsion unit 13, means 95 are provided on the transom bracket means 21 and on the intermediate bracket 23 for providing side support to the intermediate bracket 23 when the propulsion unit 13 is located within the trim range and within a limited portion of the tilt range extending upwardly from the full trim position, i.e., within a shallow water drive range.

Figure 1:
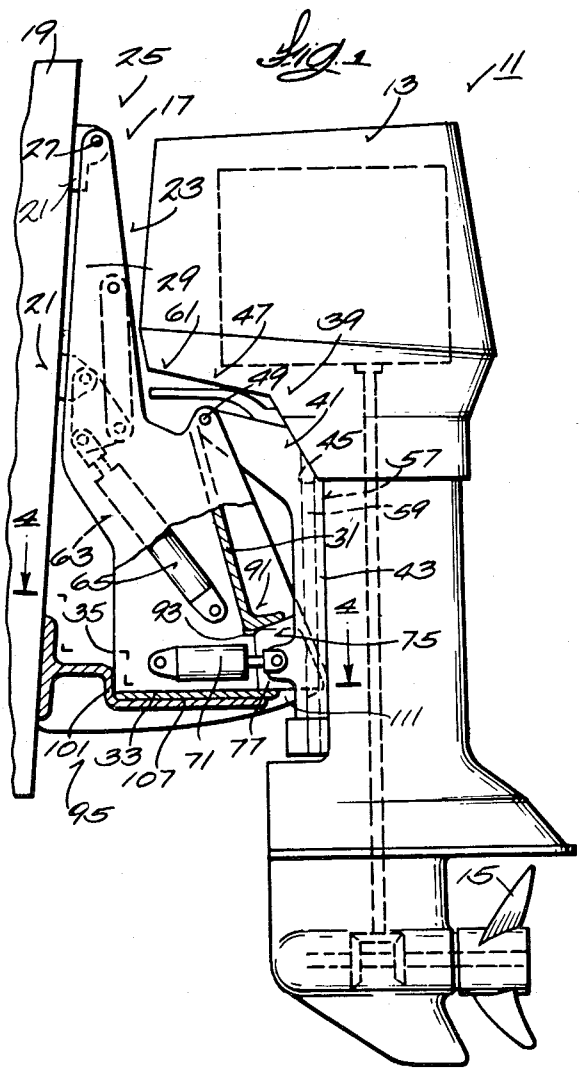
FIG. 1 is a side elevational view of an outboard motor which embodies various of the features of the invention, and which is shown in the lowermost running position.

Various constructions can be employed. In the disclosed construction, the means 95 for providing side support between the intermediate bracket and the transom bracket means comprises a support bracket 97 which is part of the transom bracket means 21 and which, in general, is U-shaped in horizontal cross-section section including two rearwardly extending arms 99 and a laterally and vertically extending web portion 101 which interconnects the arms 99 and which is adapted to be engaged, as shown in FIG. 1, by the lower forward edge of the intermediate bracket 23 for transmission thereto of forward thrust when the propulsion unit 13 is in the trim range. The rearwardly extending arms 99 respectively includes side surfaces 103 which are located for lateral engagement with adjacent side surfaces 105 of the wing portions 29 of the intermediate bracket 23 for transmission therebetween of side loading, while at the same time, affording relative displacement about the upper pivot axis 27 between the intermediate bracket 23 and the transom bracket means 21.

The support bracket 97 also desireably includes a laterally and generally horizontally extending reinforcing web 107 which extends between the arms 99 adjacent to the lower part thereof and below the intermediate bracket 23.

It is noted that the wing portions 29 of the intermediate bracket 23 includes lower rearward parts 111 which extend to adjacent the vertical leg 43 of the swivel bracket 41 and that the support arms 99 of the support bracket 97 extend to adjacent the lower rearward part 111 of the wing portion 29 of the intermediate bracket 23. The side surfaces 103 and 105 of both the support arms 99 and the intermediate bracket 23 also extend from adjacent the boat transom to the rearward part 111 of the intermediate bracket 23 and of the support arms 99.

In operation, movement of the swivel bracket 41 and propulsion unit 13 within the trim range does not disturb the location of the intermediate bracket 23 relative to the support bracket 97 with the forward edge of transverse web or shelf 33 of the intermediate bracket 23 and with the lower end of the forward edges 35 of the wing portions 29 of the intermediate bracket in engagement with the web 101 of the support bracket 97 for transmission of propulsive thrust from the intermediate bracket 23 to the support bracket 97 as shown both in FIG. 1 and FIG. 2. Thus, throughout the movement of the propulsion unit 13 in the trim range, side loading is effectively transmitted through the side surfaces 79 and 81 from the swivel bracket 41 to the intermediate bracket 23 and through the side surfaces 103 and 105 from the intermediate bracket 23 to the support bracket 97.

Figure 3:
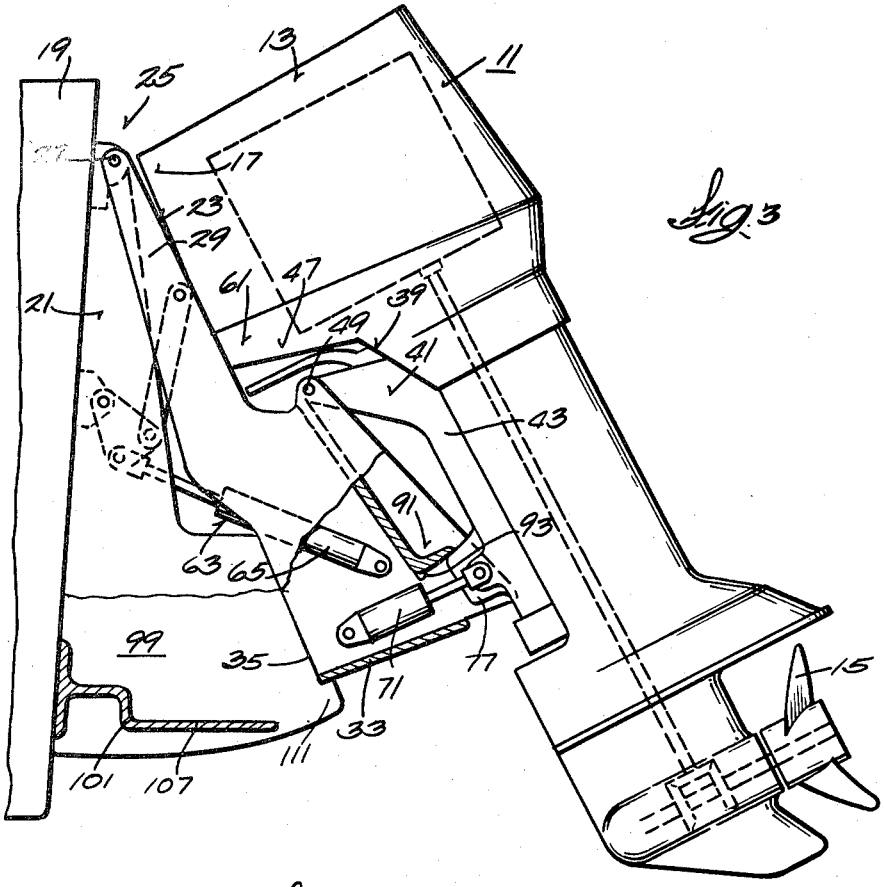
FIG. 3 is a view similar to FIG. 1 illustrating the outboard motor in a shallow water drive position.
Figure 4:
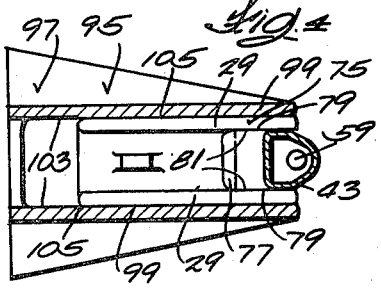
FIG. 4 is a schematic view taken generally along line 4—4 of FIG. 1 and illustrating the relative position of various of the components when the outboard motor is in the lowermost running position.
Figure 5:
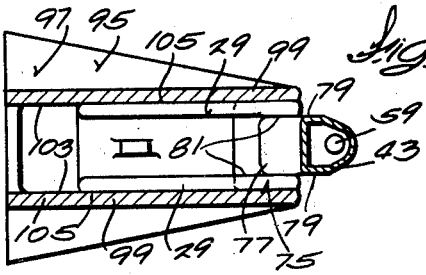
FIG. 5 is a view similar to FIG. 4 showing the components when the outboard motor is in the full trim position shown in FIG. 2.
Figure 6:
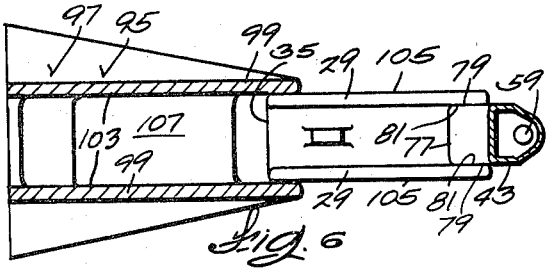
FIG. 6 is a view similar to FIG. 4 showing the components when the outboard motor is in the shallow water drive position shown in FIG. 3.
Figure 7:
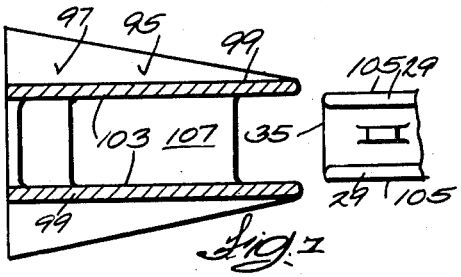
FIG. 7 is a view similar to FIG. 4 showing the components when the outboard motor is in the full tilt position.

When the propulsion unit 13 moves upwardly from the trim range through the shallow water drive range, the intermediate bracket 23 moves upwardly and rearwardly from the support bracket 97, thus diminishing the area of engagement between the side surfaces 103 and 105. However, as shown particularly in FIG. 3, the rearward extent of the support arms 99 is sufficient to provide some side support within the lower part of the tilt range, i.e., within the shallow water drive range. Upon movement of the propulsion unit 13 beyond the shallow water drive range, and into the upper part of the tilt range, the side surfaces 103 and 105 disengage, as shown in FIG. 7, and the support bracket 97 no longer provides side support for the propulsion unit 13.

Various of the features of the invention are set forth in the following claims.

We claim:

1. An outboard motor comprising transom bracket means adapted to be connected to a boat transom, a propulsion unit including a propeller, means mounting said propulsion unit to said transom bracket means for pivotal steering movement of said propulsion unit in a horizontal plane about a vertical axis and for pivotal movement of said propulsion unit in a vertical plane between a lowermost running position and a full tilt position, and through a trim range extending upwardly from said lowermost running position to a full trim position, and through a tilt range extending upwardly from said full trim position and to said full tilt position, said propulsion unit mounting means comprising an intermediate bracket having a lower end, first pivot means connecting said intermediate bracket to said transom bracket means for pivotal movement of said intermediate bracket relative to said transom bracket means about a first pivot axis which is horizontal when said transom bracket means is boat mounted, whereby to enable movement of said propulsion unit through said tilt range, a swivel bracket, second pivot means connecting said swivel bracket to said intermediate bracket for pivotal movement of said swivel bracket with said intermediate bracket and relative to said intermediate bracket about a second pivot axis parallel to and below said first pivot axis and such that said swivel bracket is only pivotal relative to said intermediate bracket about said second pivot axis, whereby to enable movement of said propulsion unit through said trim range, and means pivotally connecting said propulsion unit to said swivel bracket for steering movement of said propulsion unit relative to said swivel bracket about an axis transverse to said first and second horizontal axes, and for common pivotal movement with said swivel bracket in a vertical plane about said first and second horizontal axes, and such that said propulsion unit is only pivotal relative to said swivel bracket about said transverse axis, means for sequentially displacing said propulsion unit from said lowermost position through said trim range and then through said tilt range to said full tilt position, and means on said transom bracket means for providing side support to said lower end of said intermediate bracket.

2. An outboard motor in accordance with claim 1 wherein said means for providing side support extends rearwardly sufficiently to provide side support to said intermediate bracket when said propulsion unit is within a limited portion of said tilt range extending upwardly from said full trim position.

3. An outboard motor comprising transom bracket means adapted to be connected to a boat transom, a propulsion unit including a propeller, means mounting said propulsion unit to said transom bracket means for pivotal steering movement of said propulsion unit in a horizontal plane about a vertical axis and for pivotal movement of said propulsion unit in a vertical plane between a lowermost running position and a full tilt position, and through a trim range extending upwardly from said lowermost running position to a full trim position, and through a tilt range extending upwardly from said full trim position and to said full tilt position, said propulsion unit mounting means comprising an intermediate bracket having a lower end with a rearward part, first pivot means connecting said intermediate bracket to said transom bracket means for pivotal movement of said intermediate bracket relative to said transom bracket means about a first pivot axis which is horizontal when said transom bracket means is boat mounted, whereby to enable movement of said propulsion unit through said tilt range, a swivel bracket having a vertical leg extending adjacent said rearward part of said intermediate bracket, second pivot means connecting said swivel bracket to said intermediate bracket for pivotal movement of said swivel bracket with said intermediate bracket and relative to said intermediate bracket about a second pivot axis parallel to and below said first pivot axis and such that said swivel bracket is only pivotal relative to said intermediate bracket about said second pivot axis, whereby to enable movement of said propulsion unit through said trim range, and means pivotally connecting said propulsion unit to said swivel bracket for steering movement of said propulsion unit relative to said swivel bracket about an axis transverse to said first and second horizontal axes, and for common pivotal movement with said swivel bracket in a vertical plane about said first and second horizontal axes, and such that said propulsion unit is only pivotal relative to said swivel bracket about said transverse axis, means for sequentially displacing said propulsion unit from said lowermost position through said trim range and then through said tilt range to said full tilt position, and means on said bracket means for providing side support to said intermediate bracket, said means for providing side support extending, when said motor is in its lowermost running position, to adjacent said rearward part of said intermediate bracket and also extending so as to provide side support to said intermediate bracket when said propulsion unit is within a limited portion of said tilt range extending upwardly from said full trim position.

4. An outboard motor comprising transom bracket means adapted to be connected to a boat transom, and including a pair of lateraly spaced rearwardly extending support arms having respective side surfaces, a propulsion unit including a propeller, means mounting said propulsion unit to said transom bracket means for pivotal steering movement of said propulsion unit in a horizontal plane about a vertical axis and for pivotal movement of said propulsion unit in a vertical plane between a lowermost running position and a full tilt position, and through a trim range extending upwardly from said lowermost running position to a full trim position, and through a tilt range extending upwardly from said full trim position and to said full tilt position, said propulsion unit mounting means comprising an intermediate bracket including, at the lower end thereof, side surfaces spaced lateraly apart, first pivot means connecting said intermediate bracket to said transom bracket means for pivotal movement of said intermediate bracket relative to said transom bracket means about a first pivot axis which is horizontal when said transom bracket means is boat mounted whereby to enable movement of said propulsion unit through said tilt range and so as to locate said side surfaces of said intermediate bracket for lateral engagement with said side surfaces of said support arms for transmission of side loading from said intermediate bracket to said transom bracket means, a swivel bracket, second pivot means connecting said swivel bracket to said intermediate bracket for pivotal movement of said swivel bracket with said intermediate bracket and relative to said intermediate bracket about a second pivot axis parallel to said first pivot axis and such that said swivel bracket is only pivotal relative to said intermediate bracket about said second pivot axis, whereby to enable movement of said propulsion unit through said trim range, and means pivotally connecting said propulsion unit to said swivel bracket for steering movement of said propulsion unit relative to said swivel bracket about an axis transverse to said first and second horizontal axes and for common pivotal movement with said swivel bracket in a vertical plane about said first and second horizontal axes and such that said propulsion unit is only pivotal relative to said swivel bracket about said transverse axis, and means for sequentially displacing said propulsion unit from said lowermost position through said trim range and then through said tilt range to said full tilt position.

5. An outboard motor comprising transom bracket means adapted to be connected to a boat transom, and including a pair of laterally spaced rearwardly extending support arms having respective side surfaces and a propulsion thrust receiving portion extending generally vertically between said support arms, a propulsion unit including a propeller, means mounting said propulsion unit to said transom bracket means for pivotal steering movement of said propulsion unit in a horizontal plane about a vertical axis and for pivotal movement of said propulsion unit in a vertical plane between a lowermost running position and a full tilt position, and through a trim range extending upwardly from said lowermost running position to a full trim position, and through a tilt range extending upwardly from said full trim position and to said full tilt position, said propulsion unit mounting means comprising an intermediate bracket including, at the lower end thereof, a pair of laterally spaced wing portions having, at the lower ends thereof, a web portion connecting said laterally spaced wing portions, and engageable by said thrust receiving portion of said transom bracket means for transmission thereto of forward propulsive thrust when said propulsion unit is in said lowermost running position, first pivot means connecting said intermediate bracket to said transom bracket means for pivotal movement of said intermediate bracket relative to said transom bracket means about a first pivot axis which is horizontal when said transom bracket means is boat mounted, whereby to enable movement of said propulsion unit through said tilt range and so as to locate said wing portions of said intermediate bracket for lateral engagement with said side surfaces of said support arms for transmission of side loading from said intermediate bracket to said transom bracket means, a swivel bracket, second pivot means connecting said swivel bracket to said intermediate bracket for pivotal movement of said swivel bracket with said intermediate bracket and relative to said intermediate bracket about a second pivot axis parallel to said first pivot axis and such that said swivel bracket is only pivotal relative to said intermediate bracket about said second pivot axis, whereby to enable movement of said propulsion unit through said trim range, and means pivotally connecting said propulsion unit to said swivel bracket for steering movement of said propulsion unit relative to said swivel bracket about an axis transverse to said first and second horizontal axes and for common pivotal movement with said swivel bracket in a vertical plane about said first and second horizontal axes and such that said propulsion unit is only pivotal relative to said swivel bracket about said transverse axis, and means for sequentially displacing said propulsion unit from said lowermost position through said trim range and then through said tilt range to said full tilt position.

6. An outboard motor in accordance with claim 5 wherein said web portion extends generally horizontally.

7. An outboard motor in accordance with claim 6 wherein said transom bracket means includes a reinforcing web extending generally horizontally between said support arms adjacent to the lower ends thereof and below said horizontally extending web portion of said intermediate bracket when said intermediate bracket is in the lowermost running position.

8. A marine propulsion device in accordance with claim 1 wherein said swivel bracket and said intermediate bracket includes means providing side support to said swivel bracket in all positions of said swivel bracket relative to said intermediate bracket.

9. A marine propulsion device in accordance with claim 8 wherein said means providing side support to said swivel bracket in all positions of said swivel bracket comprises laterally spaced side surfaces on said intermediate bracket, and wherein said swivel bracket includes a forwardly extending part having side surfaces located for lateral engagement with said side surfaces of said intermediate bracket for transmission of side loading from said swivel bracket to said intermediate bracket.

10. A marine propulsion device in accordance with claim 1 and further including means on said intermediate bracket engageable with said swivel bracket for limiting downward pivotal movement of said swivel bracket relative to said intermediate bracket and for receiving forward propulsion thrust from said swivel bracket when said propulsion unit is in said lowermost position.

11. An outboard motor in accordance with claim 1 wherein said first pivot means connecting said intermediate bracket and said transom bracket means is located rearwardly of the boat transom.

12. A outboard motor in accordance with claim 1 wherein said first and second pivot axes are spaced apart.

13. A outboard motor comprising transom bracket means adapted to be connected to a boat transom, a propulsion unit including a propeller, means mounting said propulsion unit to said transom bracket means for pivotal steering movement of said propulsion unit in a horizontal plane about a vertical axis and for pivotal movement of said propulsion unit in a vertical plane between a lowermost running position and a full tilt position, and through a trim range extending upwardly from said lowermost running position to a full trim position, and through a tilt range extending upwardly from said full trim position and to said full tilt position, said propulsion unit mounting means comprising an intermediate bracket having a lower end, first pivot means connecting said intermediate bracket to said transom bracket means for pivotal movement of said intermediate bracket relative to said transom bracket means about a first pivot axis which is horizontal when said transom bracket means is boat mounted, whereby to enable movement of said propulsion unit through said tilt range, a swivel bracket, second pivot means connecting said swivel bracket to said intermediate bracket for pivotal movement of said swivel bracket with said intermediate bracket and relative to said intermediate bracket about a second pivot axis located parallel to said pivot axis and below said first pivot axis, and such that said swivel bracket is only pivotal relative to said intermediate bracket about said second pivot axis, whereby to enable movement of said propulsion unit through said trim range, and means pivotally connecting said propulsion unit relative to said swivel bracket for steering movement of said propulsion unit relative to said swivel bracket about an axis which is transverse to said first and second horizontal axes and for common pivotal movement with said swivel bracket in a vertical plane about said first and second horizontal axes and such that said propulsion unit is only pivotal relative to said swivel bracket about said transverse axis, means for sequentially displacing said propulsion unit from said lowermost position through said trim range and then through said tilt range to said full tilt position, and means on said transom bracket means for providing side support to said lower end of said intermediate bracket.

14. An outboard motor comprising transom bracket means adapted to be connected to a boat transom, a propulsion unit including a propeller, means mounting said propulsion unit to said transom bracket means for pivotal steering movement of said propulsion unit in a horizontal plane about a vertical axis and for pivotal movement of said propulsion unit in a vertical plane between a lowermost running position and a full tilt position, and through a trim range extending upwardly from said lowermost running position to a full trim position, and through a tilt range extending upwardly from said full trim position and to said full tilt position, said propulsion unit mounting means comprising an intermediate bracket having a lower end, first pivot means connecting said intermediate bracket to said transom bracket means for pivotal movement of said intermediate bracket relative to said transom bracket means about a first pivot axis which is horizontal when said transom bracket means is boat mounted, whereby to enable movement of said propulsion unit through said tilt range, a swivel bracket, second pivot means connecting said swivel bracket to said intermediate bracket for pivotal movement of said swivel bracket with said intermediate bracket and relative to said intermediate bracket about a second pivot axis located parallel to and below said first pivot axis and such that said swivel bracket is only pivotal relative to said intermediate bracket about said second pivot axis, whereby to enable movement of said propulsion unit through said trim range, and means pivotally connecting said propulsion unit to said swivel bracket for steering movement of said propulsion unit relative to said swivel bracket about an axis transverse to said first and second horizontal axes and for common pivotal movement with said swivel bracket in a vertical plane about said first and second horizontal axes and such that said propulsion unit is only pivotal relative to said swivel bracket about said transverse axis, means for sequentially displacing said propulsion unit from said lowermost position through said trim range and then through said tilt range to said full tilt position, and means on said transom bracket means for providing side support to said lower end of said intermediate bracket, said means for providing side support for said lower end of said intermediate bracket comprising a support bracket forming a part of said transom bracket means and including a pair of laterally spaced support arms having respective side surfaces and additional side surfaces forming a part of said lower end of said intermediate bracket and located for lateral engagement with said side surfaces of said support bracket for transmission of side loading from said lower end of said intermediate bracket to said support bracket.

* * * * *